US011103982B2

(12) United States Patent
Li et al.

(10) Patent No.: US 11,103,982 B2
(45) Date of Patent: Aug. 31, 2021

(54) WRENCH STRUCTURE

(71) Applicants: Hong-Jen Li, Taichung (TW); Jian-Ying Li, Taichung (TW)

(72) Inventors: Hong-Jen Li, Taichung (TW); Jian-Ying Li, Taichung (TW)

( * ) Notice: Subject to any disclaimer, the term of this patent is extended or adjusted under 35 U.S.C. 154(b) by 222 days.

(21) Appl. No.: 16/540,140

(22) Filed: Aug. 14, 2019

(65) Prior Publication Data

US 2021/0046622 A1 Feb. 18, 2021

(51) Int. Cl.

| | |
|---|---|
| ***B25B 23/16*** | (2006.01) |
| ***B25B 23/00*** | (2006.01) |
| ***B25B 13/06*** | (2006.01) |

(52) U.S. Cl.

CPC ..... *B25B 23/0028* (2013.01); *B25B 13/06* (2013.01); *B25B 23/0035* (2013.01)

(58) Field of Classification Search

CPC ..... B25B 23/0028; B25G 1/025

See application file for complete search history.

(56) References Cited

U.S. PATENT DOCUMENTS 6,260,452 B1 * 7/2001 Yu ..... B25B 23/0021 81/177.2

7,311,018 B1 * 12/2007 Liou ..... B25B 13/005 81/177.5

7,331,261 B2 * 2/2008 Blizniuk ..... B25B 23/0035 81/124.4

* cited by examiner

*Primary Examiner* — Lee D Wilson

*Assistant Examiner* — Donna Maynard

(74) *Attorney, Agent, or Firm* — Alan D. Kamrath; Karin L. Williams; Mayer & Williams PC

(57) ABSTRACT

A wrench structure includes a first wrench body, a second wrench body, and a pivot member. The first wrench body is provided with a first mounting portion which is a hexagonal through hole. The first wrench body has a first end provided with a first pivot portion, and a second end provided with a second mounting portion which is a square head. The first pivot portion is provided with a first pivot hole. The second wrench body is provided with a second pivot portion which is pivotally connected with the first pivot portion of the first wrench body. The second pivot portion is provided with a second pivot hole. The pivot member extends through the second pivot hole and the first pivot hole, such that the second wrench body is pivotally connected with the first wrench body.

6 Claims, 12 Drawing Sheets

A-A

WRENCH STRUCTURE

BACKGROUND OF THE INVENTION

1. Field of the Invention

The present invention relates to a hand tool and, more particularly, to a wrench structure.

2. Description of the Related Art

A conventional wrench structure 90 in accordance with the prior art shown in FIG. 14 comprises a handle 91, a head 92 mounted on the handle 91, and a pivot rod 93 extending through the handle 91 and the head 92, such that the handle 91 and the head 92 are connected pivotally. The handle 91 is provided with a pivot recess 911 for mounting the head 92. The head 92 is provided with a driving portion 921 protruding from the pivot recess 911 of the handle 91. The driving portion 921 is a square head. The driving portion 921 may cooperate with a hand tool, such as a socket, to drive and rotate a workpiece, such as a nut, a bolt or the like. However, the driving portion 921 only has a single specification, such that the conventional wrench structure 90 is only available for the hand tool with a square cavity, and cannot be used for hand tools of different specifications, thereby limiting the versatility of the conventional wrench structure 90.

BRIEF SUMMARY OF THE INVENTION

The primary objective of the present invention is to provide a wrench structure that is available for hand tools of two different specifications.

In accordance with the present invention, there is provided a wrench structure comprising a first wrench body, a second wrench body, and a pivot member. The first wrench body is provided with a first mounting portion which is a hexagonal through hole. The first wrench body has a first end provided with a first pivot portion. The first pivot portion is provided with a first pivot hole. The first wrench body has a second end provided with a second mounting portion which is a square head. The second wrench body is provided with a second pivot portion which is pivotally connected with the first pivot portion of the first wrench body. The second pivot portion is provided with a second pivot hole. The pivot member extends through the second pivot hole and the first pivot hole, such that the second wrench body is pivotally connected with the first wrench body.

According to the primary advantage of the present invention, the first mounting portion and the second mounting portion are used to for mounting hand tools of two different specifications, thereby enhancing the versatility of the wrench structure.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
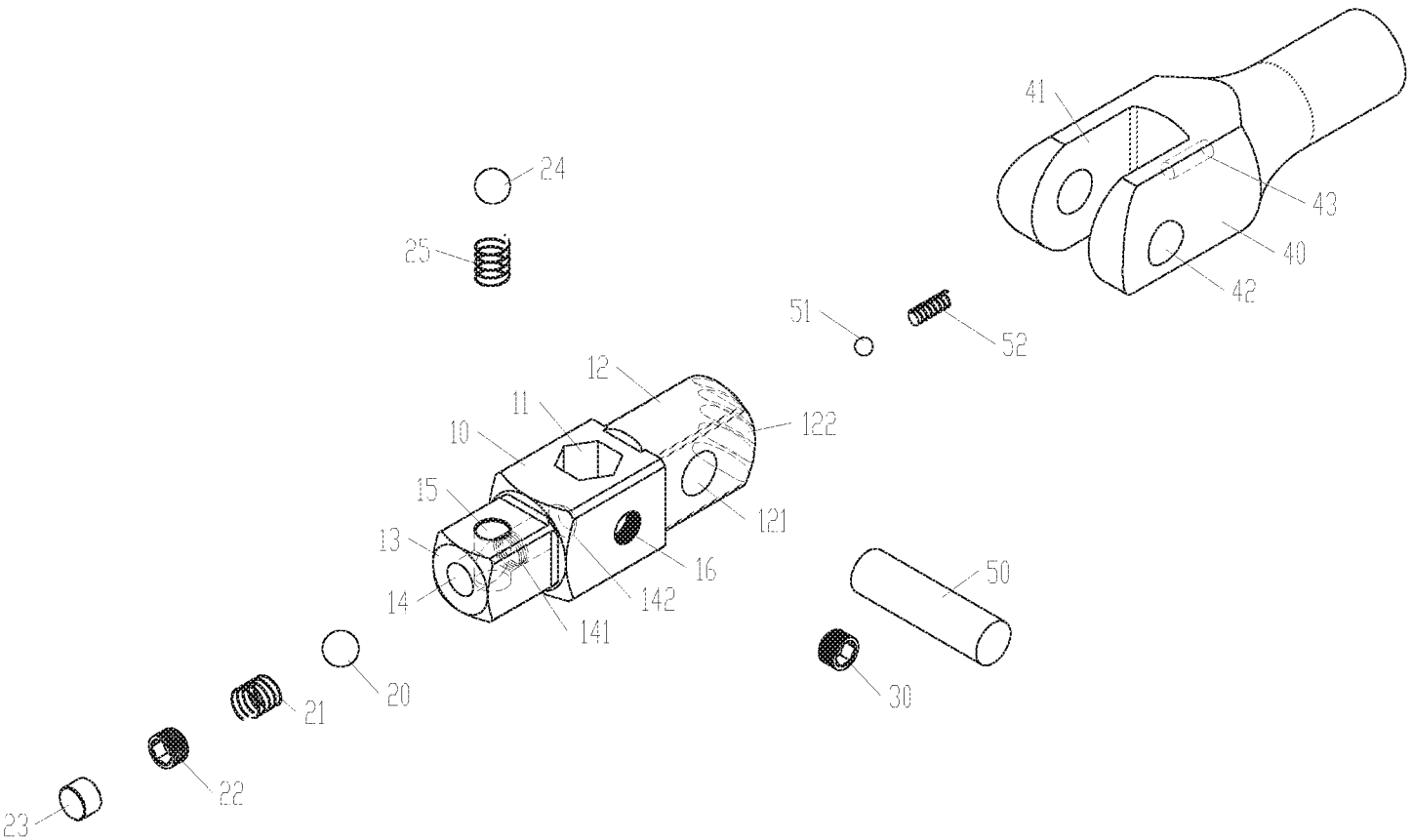
FIG. 1 is an exploded perspective view of a wrench structure in accordance with the preferred embodiment of the present invention.
Figure 2:
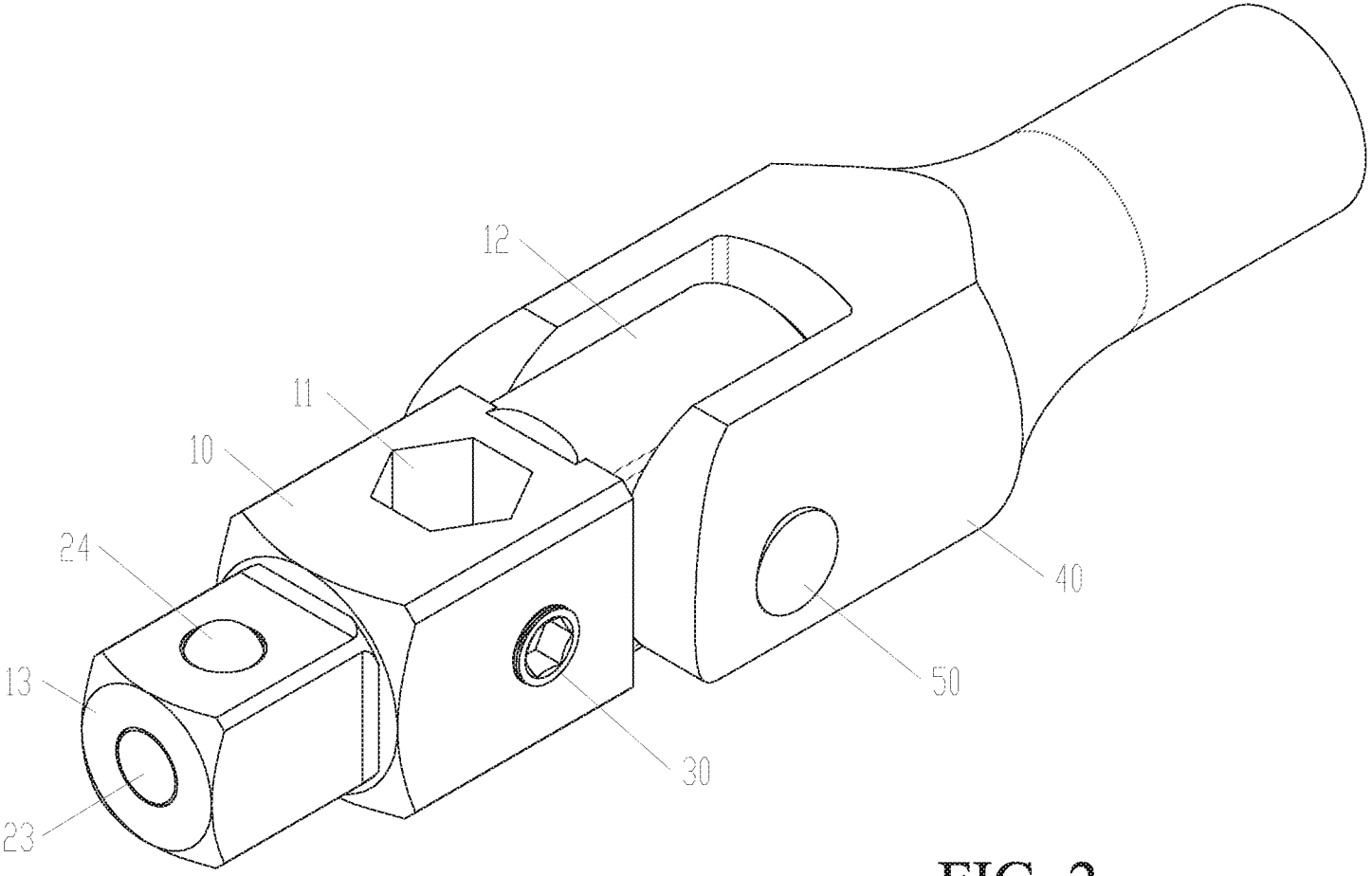
FIG. 2 is a perspective view of the wrench structure in accordance with the preferred embodiment of the present invention.
Figure 3:
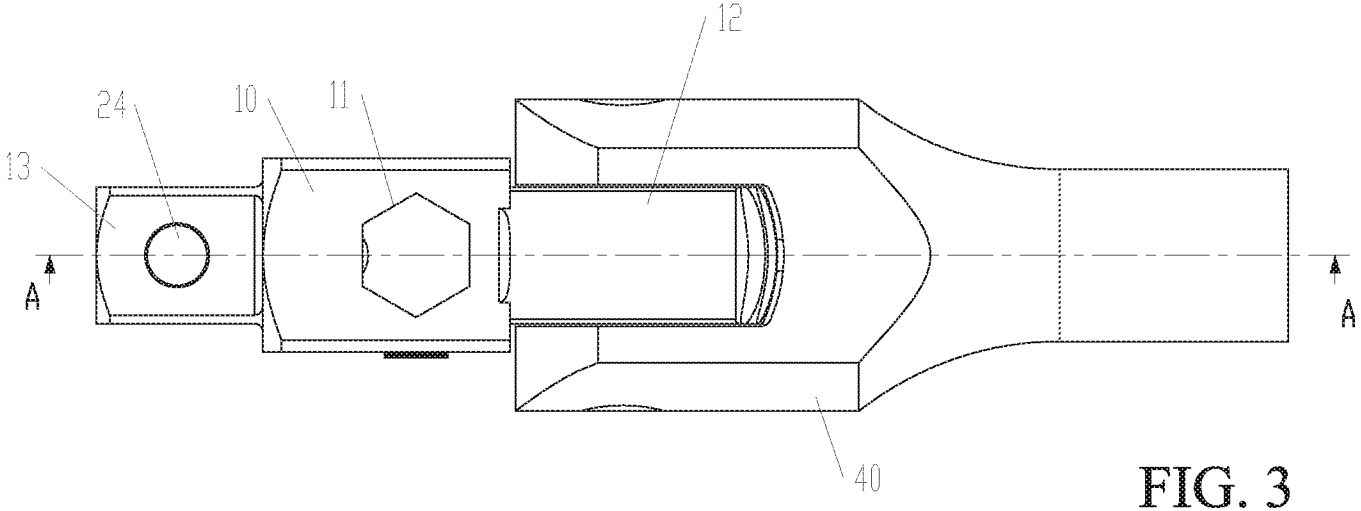
FIG. 3 is a top view of the wrench structure as shown in FIG. 2.
Figure 4:
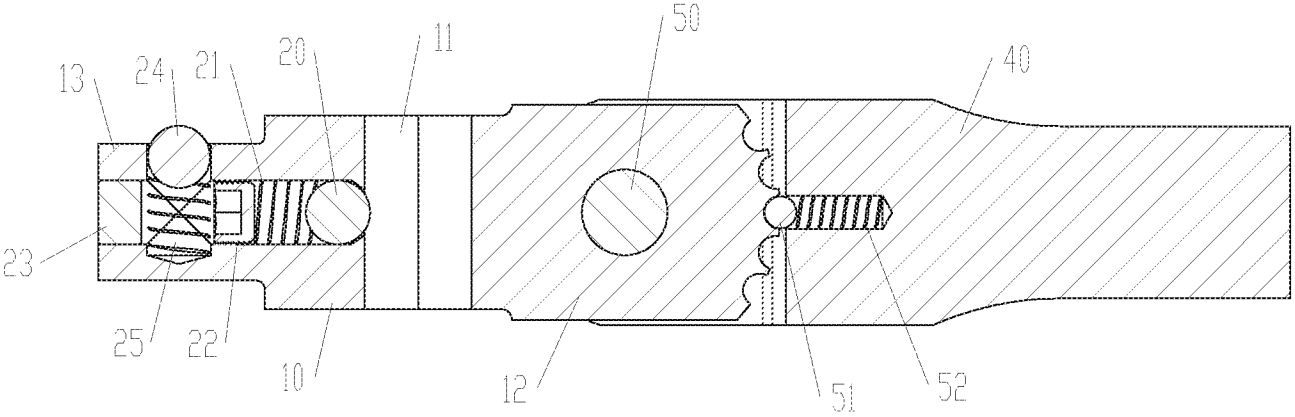
FIG. 4 is a cross-sectional view of the wrench structure taken along line A-A as shown in FIG. 3.

Referring to the drawings and initially to FIGS. 1-4, a wrench structure in accordance with the preferred embodiment of the present invention comprises a first wrench body 10, a first ball 20, a first elastic member 21, a first screw member 22, a second ball 24, a second elastic member 25, a second screw member 30, a second wrench body 40, a pivot member 50, a third ball 51, and a third elastic member 52.

The first wrench body 10 is provided with a first mounting portion 11 which is a hexagonal through hole. The first wrench body 10 has a first end provided with a first pivot portion 12. The first pivot portion 12 is provided with a first pivot hole 121 which has a circular shape. The first pivot hole 121 has an axis which is perpendicular to and spaced from that of the first mounting portion 11. The first pivot portion 12 has an end portion provided with a plurality of positioning grooves 122 which are spaced from that of the first mounting portion 11. Preferably, the first pivot portion 12 has five positioning grooves 122. Each of the positioning grooves 122 has a concave arcuate shape. The positioning grooves 122 are arranged in an annular shape about the first pivot hole 121. The first wrench body 10 has a second end provided with a second mounting portion 13 which is a square head. The first mounting portion 11 is located between the first pivot portion 12 and the second mounting portion 13. The second mounting portion 13 has an axis which is perpendicular to and intersects that of the first mounting portion 11. The second mounting portion 13 is provided with a first receiving recess 14 which has a circular shape and is connected to the first mounting portion 11. The first receiving recess 14 has an axis which is perpendicular to that of the first mounting portion 11. The first receiving recess 14 is provided with a first threaded section 141 which is preferably an internal thread. The first receiving recess 14 is provided with a first abutting edge 142 which is located between the first mounting portion 11 and the first receiving recess 14. The second mounting portion 13 is provided with a second receiving recess 15 which has a circular shape and is connected to the first receiving recess 14. The second receiving recess 15 has an axis which is perpendicular to that of the first receiving recess 14 and is parallel with that of the first mounting portion 11. The first threaded section 141 is located between the first abutting edge 142 and the second receiving recess 15 and is close to the second receiving recess 15. The first wrench body 10 has a side provided with a second threaded section 16 which is preferably an internal thread. The second threaded section 16 is connected to the first mounting portion 11 and has an axis which is perpendicular to that of the first mounting portion 11. The axes of the first mounting portion 11, the second mounting portion 13, and the second threaded section 16 are perpendicular to each other and intersect at a point.

The first ball 20 is received in the first receiving recess 14 and rests on the first abutting edge 142. The first ball 20 partially extends into the first mounting portion 11 and is restricted by the first abutting edge 142 which prevents the first ball 20 from being detached from the first receiving recess 14, and prevents the first ball 20 from fully entering the first mounting portion 11.

The first elastic member 21 is received in the first receiving recess 14 and presses the first ball 20 toward the first abutting edge 142.

The first screw member 22 is screwed into the first threaded section 141, and rests on the first elastic member 21 to limit and prevent the first ball 20 and the first elastic member 21 from being detached from the first receiving recess 14. The first elastic member 21 is biased between the first ball 20 and the first screw member 22.

The second ball 24 is received in and partially protrudes outward from the second receiving recess 15.

The second elastic member 25 is received in the second receiving recess 15, and is biased between a wall of the second receiving recess 15 and the second ball 24, such that the second ball 24 is pushed by the second elastic member 25 and partially protrudes outward from the second receiving recess 15.

The second screw member 30 has an external thread and is screwed into the second threaded section 16. The second screw member 30 is rotatable and movable in the second threaded section 16.

The second wrench body 40 is pivotally connected with the first wrench body 10. The second wrench body 40 is provided with a second pivot portion 41 which is pivotally connected with the first pivot portion 12 of the first wrench body 10. The second pivot portion 41 has a U-shaped configuration and is provided with a second pivot hole 42 which aligns with the first pivot hole 121. The second wrench body 40 is pivoted relative to the first wrench body 10 about an axis which is defined by the first pivot hole 121 and the second pivot hole 42. The second pivot hole 42 is connected to and transversely extends through the second pivot portion 41. The second pivot hole 42 has a circular shape and has an end face provided with a third receiving recess 43 which aligns with one of the positioning grooves 122, to adjust a positioning angle between the first wrench body 10 and the second wrench body 40. The third receiving recess 43 is connected to the second pivot portion 41.

The pivot member 50 is a circular shaft which extends through the second pivot hole 42 and the first pivot hole 121, such that the second wrench body 40 is pivotally connected with the first wrench body 10.

The third ball 51 is received in the third receiving recess 43. The third ball 51 partially protrudes from the third receiving recess 43 and is positioned in one of the positioning grooves 122.

The third elastic member 52 is received in the third receiving recess 43 and is biased between a wall of the third receiving recess 43 and the third ball 51, to push the third ball 51 toward the first pivot portion 12, such that the third ball 51 is moved into and positioned in one of the positioning grooves 122. Thus, the second wrench body 40 and the first wrench body 10 are positioned.

In the preferred embodiment of the present invention, the wrench structure further comprises a closure 23 received in the first receiving recess 14 and located at an opening of the first receiving recess 14, to close the first receiving recess 14.

In the preferred embodiment of the present invention, the second ball 24 has a specification the same as that of the first ball 20. The second elastic member 25 is arranged between the first screw member 22 and the closure 23. In fabrication, the second receiving recess 15 is processed by a working method, such as stamping (or pressing or punching), after the second ball 24 and the second elastic member 25 are received in the second receiving recess 15, such that the second receiving recess 15 has a reduced diameter, to prevent the second ball 24 and the second elastic member 25 from being detached from the second receiving recess 15.

Figure 5:
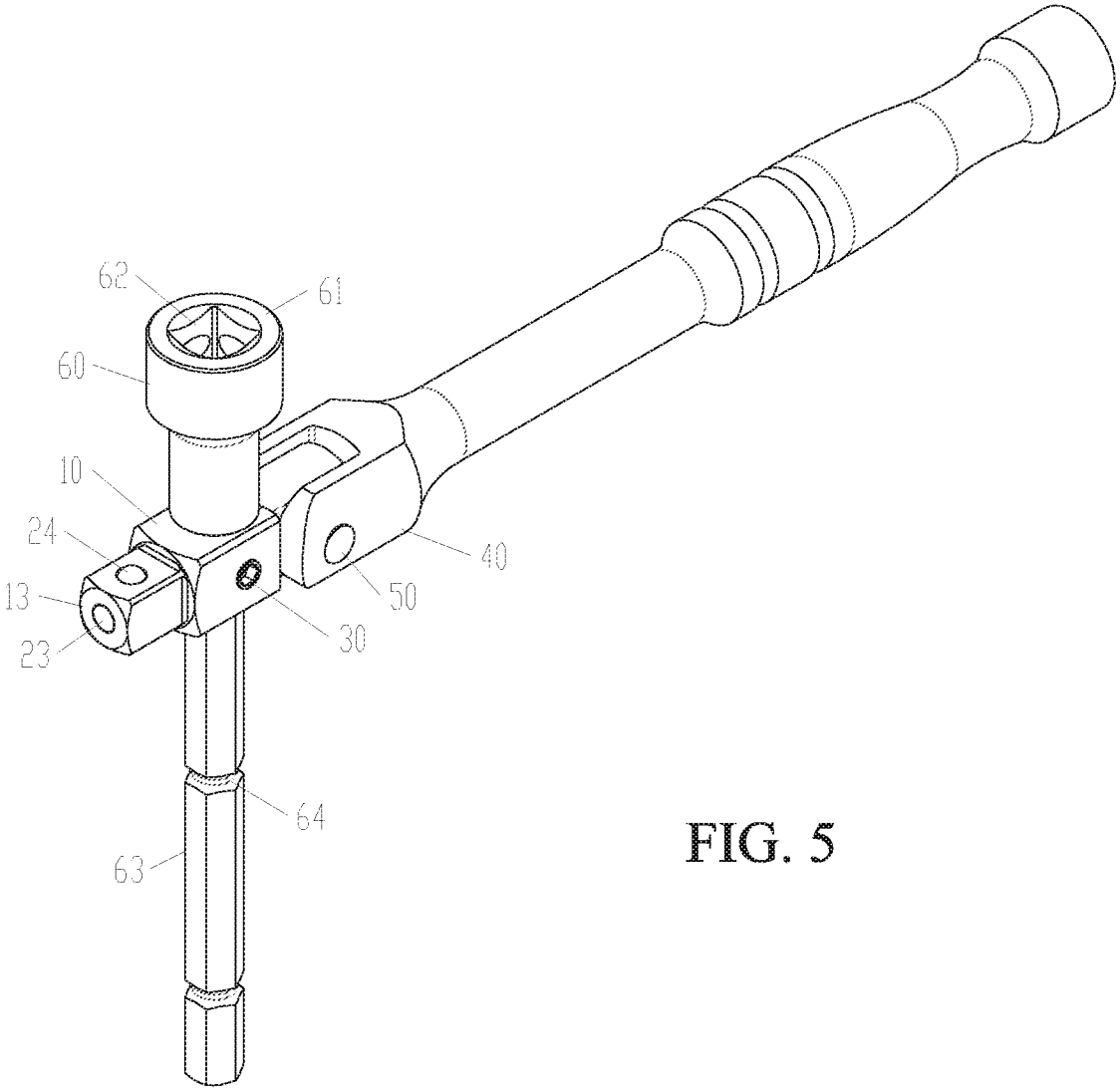
FIG. 5 is a perspective view showing a first operation mode of the wrench structure and a first tool.
Figure 6:
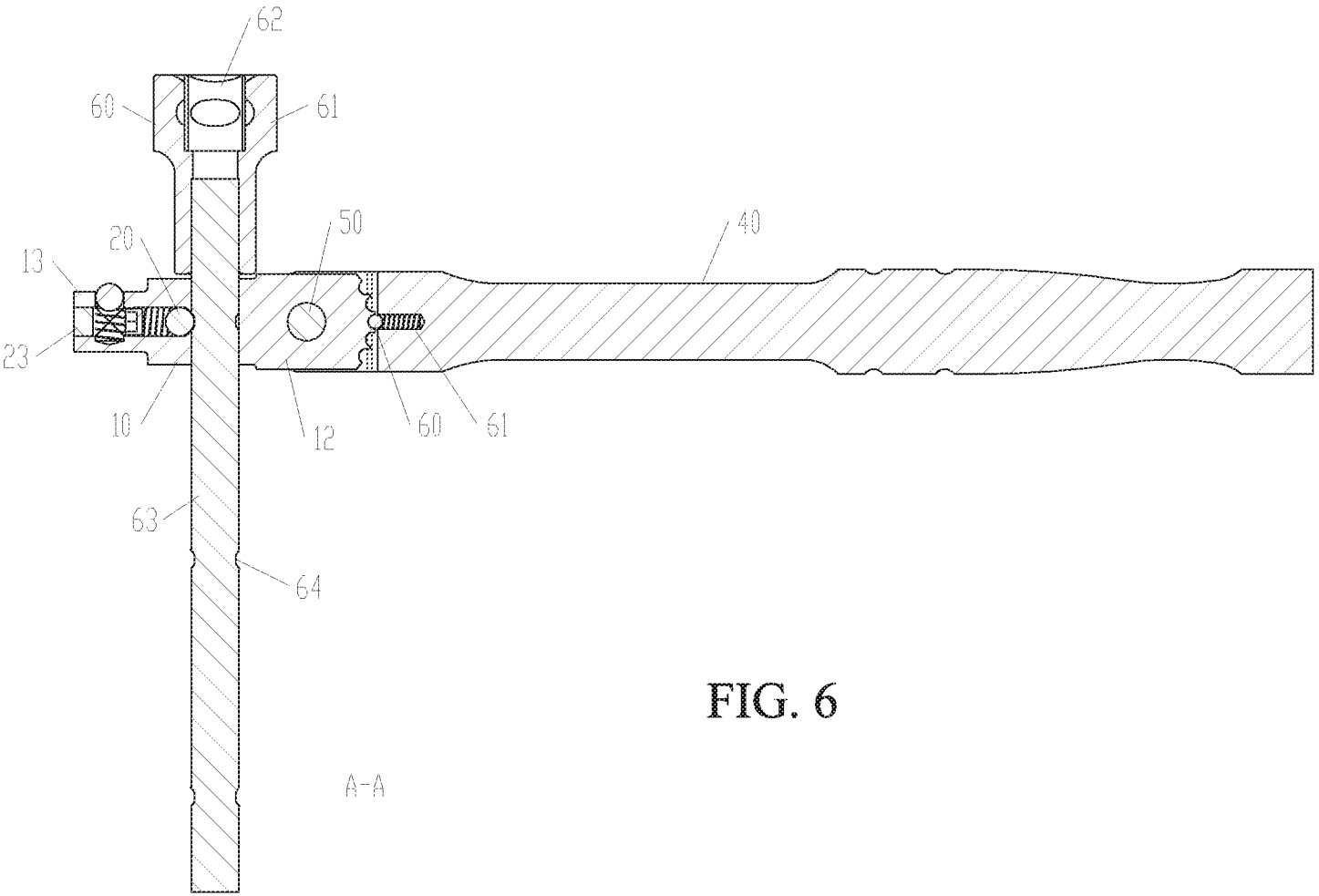
FIG. 6 is a cross-sectional view of the first operation mode of the wrench structure and the first tool as shown in FIG. 5.

Referring to FIGS. 5 and 6 with reference to FIGS. 1-4, a first tool 60 is connected with the wrench structure. The first tool 60 includes a third mounting portion 61, a fourth mounting portion 62, and a fifth mounting portion 63. The third mounting portion 61 has a cylindrical or hexagonal shape. The fourth mounting portion 62 is a square recess which is formed in the third mounting portion 61. The fourth mounting portion 62 may be mounted on the second mounting portion 13. The fourth mounting portion 62 has a specification the same as that of the second mounting portion 13. The fifth mounting portion 63 is connected with the third mounting portion 61. The fifth mounting portion 63 is a hexagonal pole (or rod or shank) which extends through the first mounting portion 11, such that the first tool 60 is assembled with the first wrench body 10. Thus, the first tool 60 and the wrench structure form an L-shaped construction or a T-shaped construction. The fifth mounting portion 63 is movable in the first mounting portion 11, to adjust a position of the fifth mounting portion 63 relative to the first wrench body 10. The fifth mounting portion 63 is provided with a plurality of annular grooves 64, and one of the annular grooves 64 aligns with the first receiving recess 14. The first ball 20 is pushed by the first elastic member 21, and is received in one of the annular grooves 64, such that the first tool 60 is positioned on the first wrench body 10. The annular grooves 64 are spaced from each other and are arranged linearly. The first tool 60 is rotated by rotation of the second wrench body 40.

The second screw member 30 may be moved in the second threaded section 16 and presses the fifth mounting portion 63, such that the second screw member 30 presses and forcibly secures the first tool 60.

Figure 7:
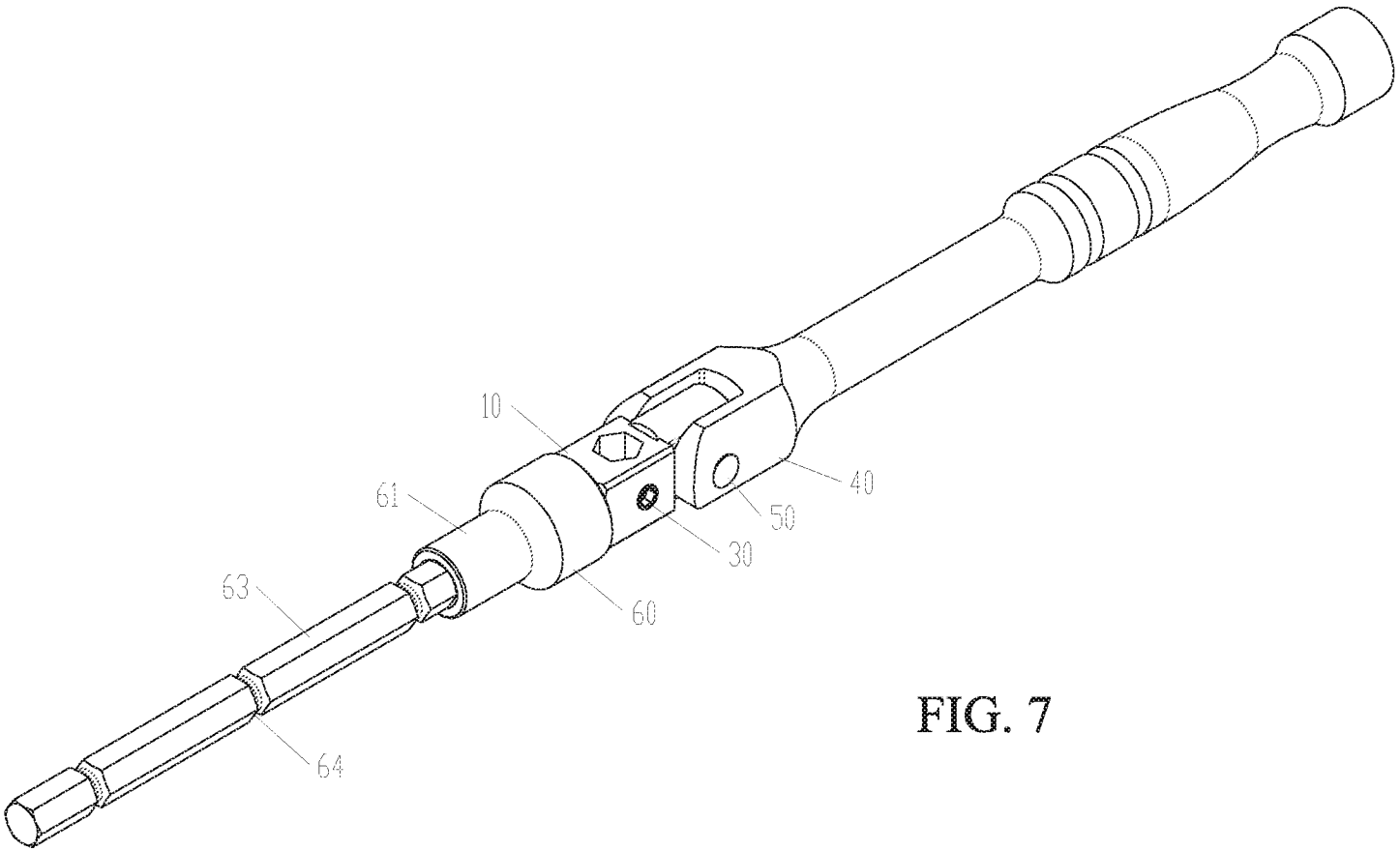
FIG. 7 is a perspective view showing a second operation mode of the wrench structure and the first tool.

Referring to FIG. 7 with reference to FIGS. 1-6, the fourth mounting portion 62 is mounted on the second mounting portion 13 of the first wrench body 10. Thus, when the second wrench body 40 is rotated, the first tool 60 is rotated by rotation of the second wrench body 40.

Figure 8:
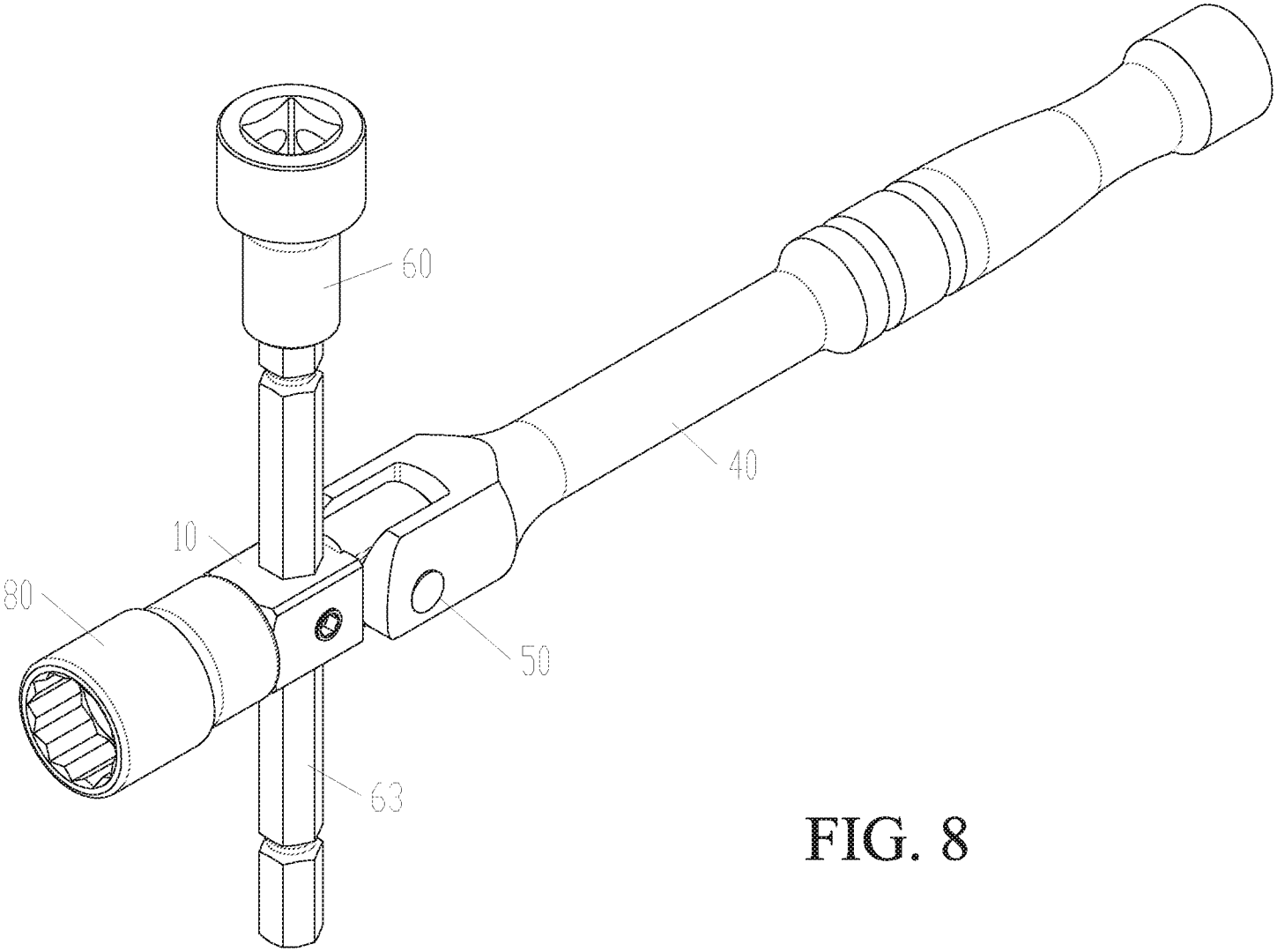
FIG. 8 is a perspective view showing combination of the wrench structure and a second tool.

Referring to FIG. 8 with reference to FIGS. 1-6, the fifth mounting portion 63 is movable in the first mounting portion 11, with one of the annular grooves 64 aligns with the first receiving recess 14. A second tool 80 is connected with the wrench structure. The second tool 80 is a socket which has a first end mounted on the second mounting portion 13 of the first wrench body 10, and a second end provided with a polygonal recess for mounting a screw element. Thus, the wrench structure, the first tool 60, and the second tool 80 form a cross wrench.

Figure 9:
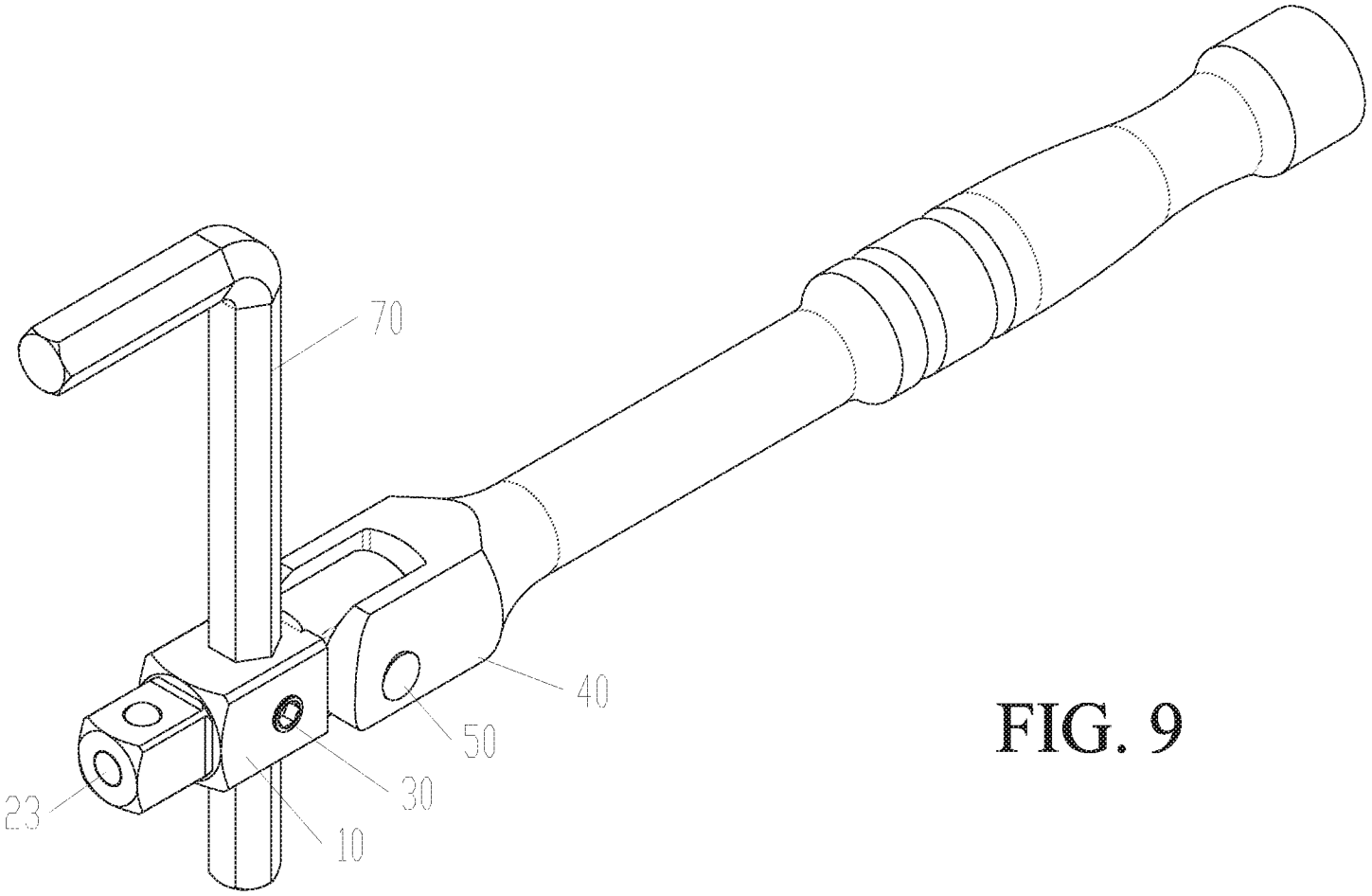
FIG. 9 is a perspective view showing a first operation mode of the wrench structure and a third tool.

Referring to FIG. 9 with reference to FIGS. 1-4, a second tool 70 is connected with the wrench structure. The second tool 70 is an L-shaped hex wrench including a first section and a second section, wherein the second section has a length greater than that of the first section. The second section of the second tool 70 is mounted on (or extends through) the first mounting portion 11 of the first wrench body 10. Alternatively, the first section of the second tool 70 may be mounted on the first mounting portion 11 of the first wrench body 10.

Figure 10:
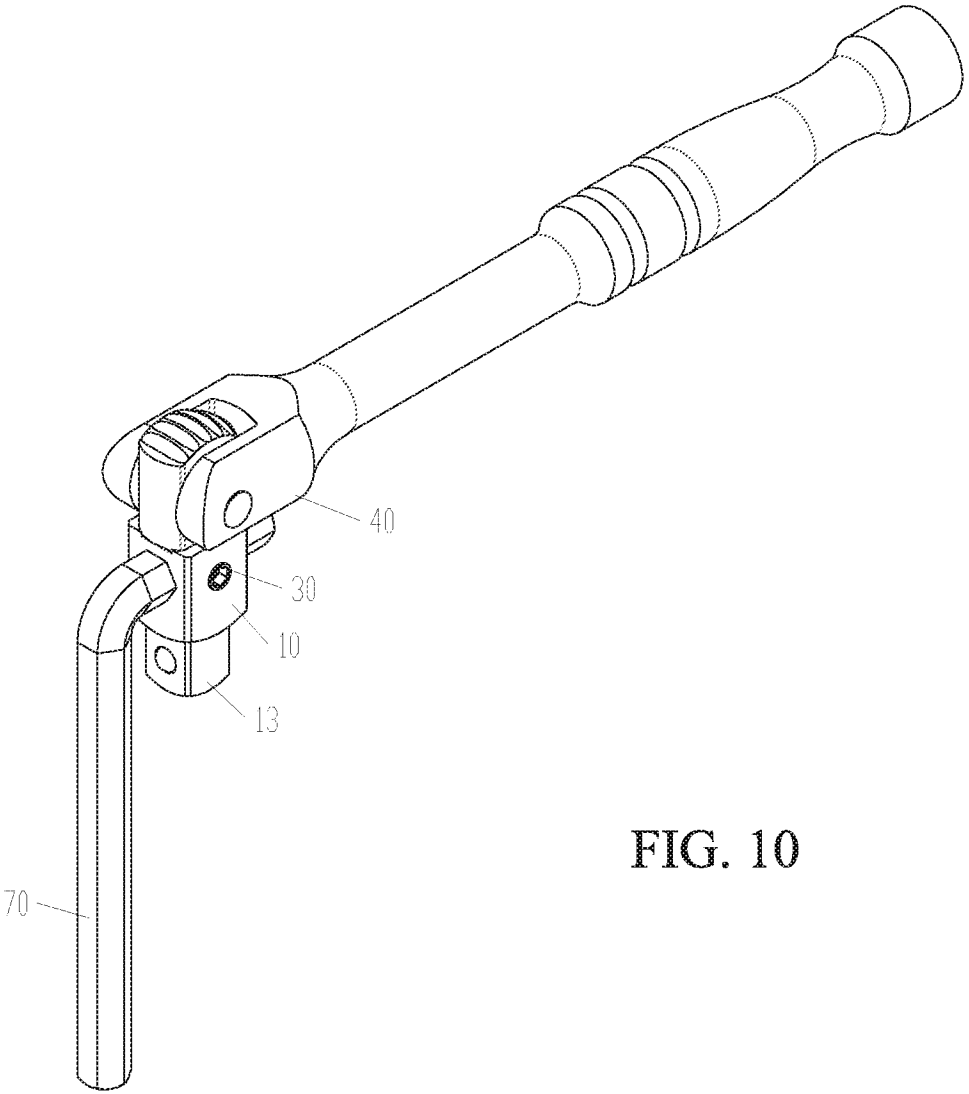
FIG. 10 is a perspective view showing a second operation mode of the wrench structure and the third tool.

Referring to FIGS. 9 and 10 with reference to FIGS. 1-4, the first pivot portion 12 of the first wrench body 10 and the second pivot portion 41 of the second wrench body 40 are pivoted about the pivot member 50, such that the first wrench body 10 and the second wrench body 40 are pivoted relative to each other to form an angle of ninety degrees between the first wrench body 10 and the second wrench body 40. Thus, the first wrench body 10 and the second wrench body 40 form an L-shaped arrangement. At this time, the first section of the second tool 70 is mounted on the first mounting portion 11 of the first wrench body 10. Thus, the second tool 70 and the wrench structure form a substantially L-shaped construction.

Figures 11, 12:
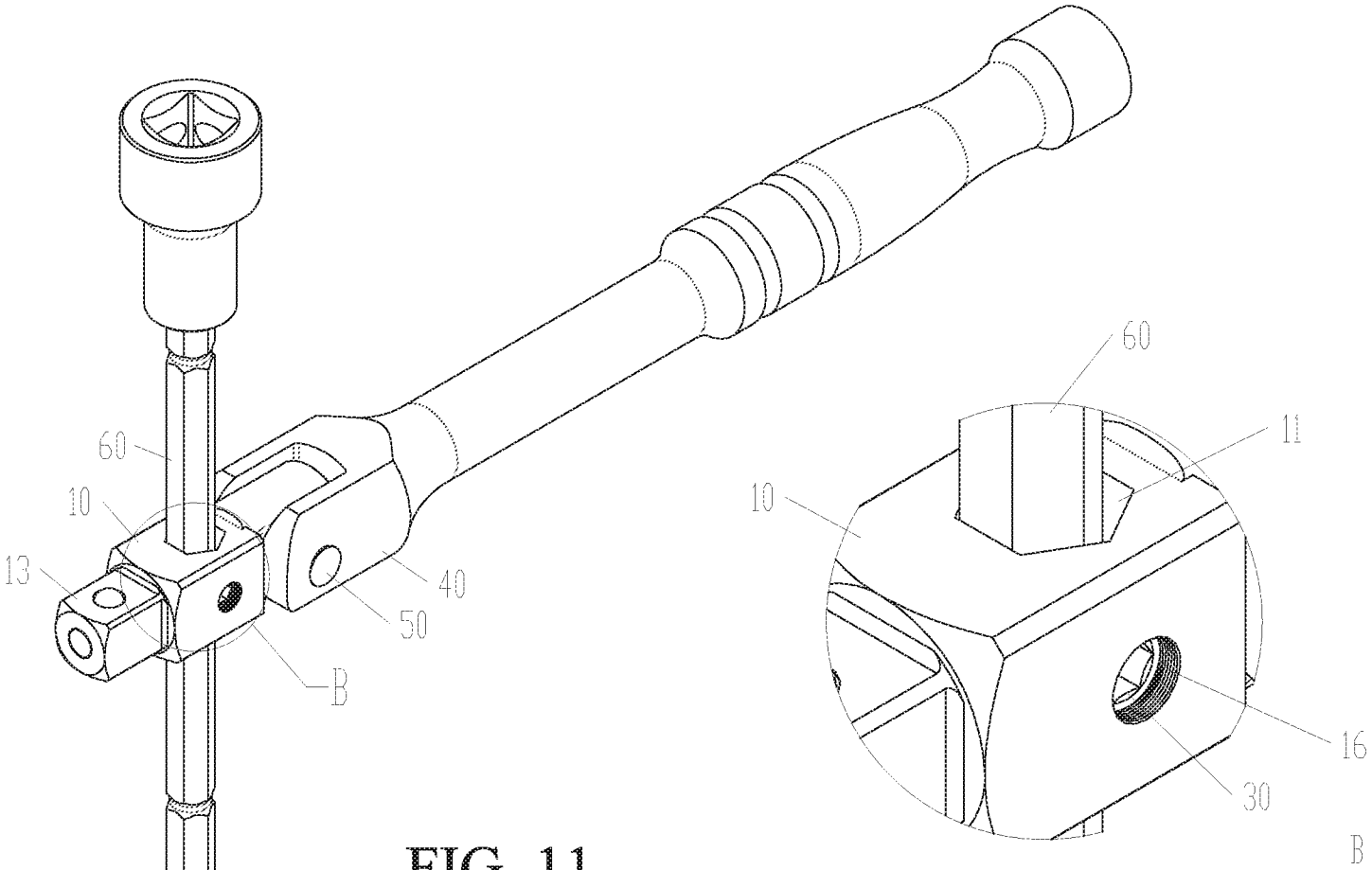
FIG. 11 is a perspective view showing a third operation mode of the wrench structure and the first tool.
FIG. 12 is a locally enlarged view of the wrench structure and the first tool taken along mark B as shown in FIG. 11.

Referring to FIGS. 11 and 12 with reference to FIGS. 1-6, the fifth mounting portion 63 of the first tool 60 is mounted on the first mounting portion 11 of the first wrench body 10. At this time, the fifth mounting portion 63 of the first tool 60 has a smaller size and has a specification smaller than that of the first mounting portion 11. When the second screw member 30 is rotated, the second screw member 30 is moved in the second threaded section 16 to press the fifth mounting portion 63 of the first tool 60, such that the fifth mounting portion 63 of the first tool 60 is locked by the second screw member 30, and the first tool 60 is combined with the first wrench body 10. In such a manner, the wrench structure is used to rotate the first tool 60 with a smaller specification. Thus, the wrench structure is used to rotate the first tool 60 with different specifications by adjustment of the second screw member 30.

Figure 13:
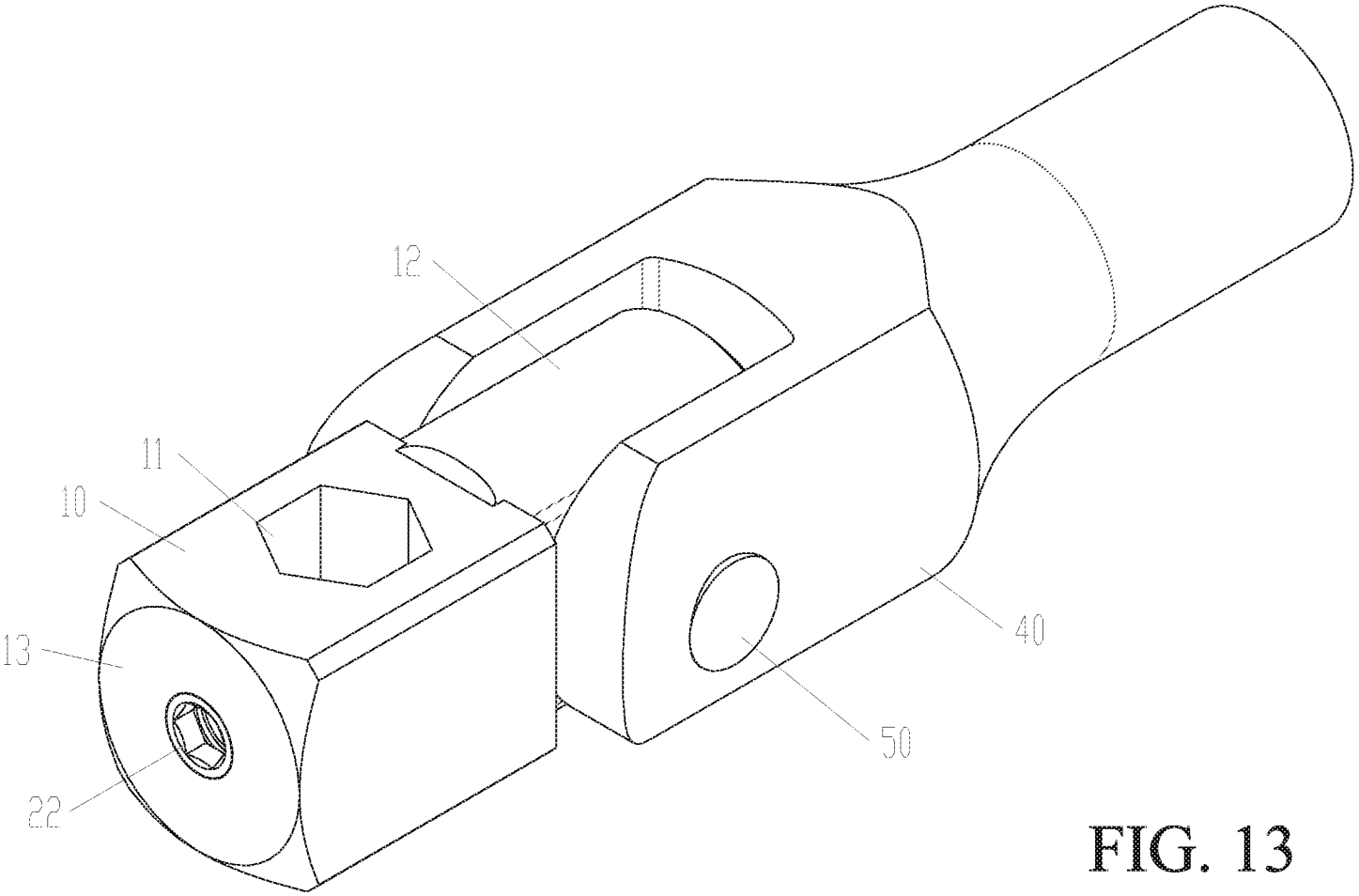
FIG. 13 is a perspective view of the wrench structure in accordance with another preferred embodiment of the present invention.
Figure 14:
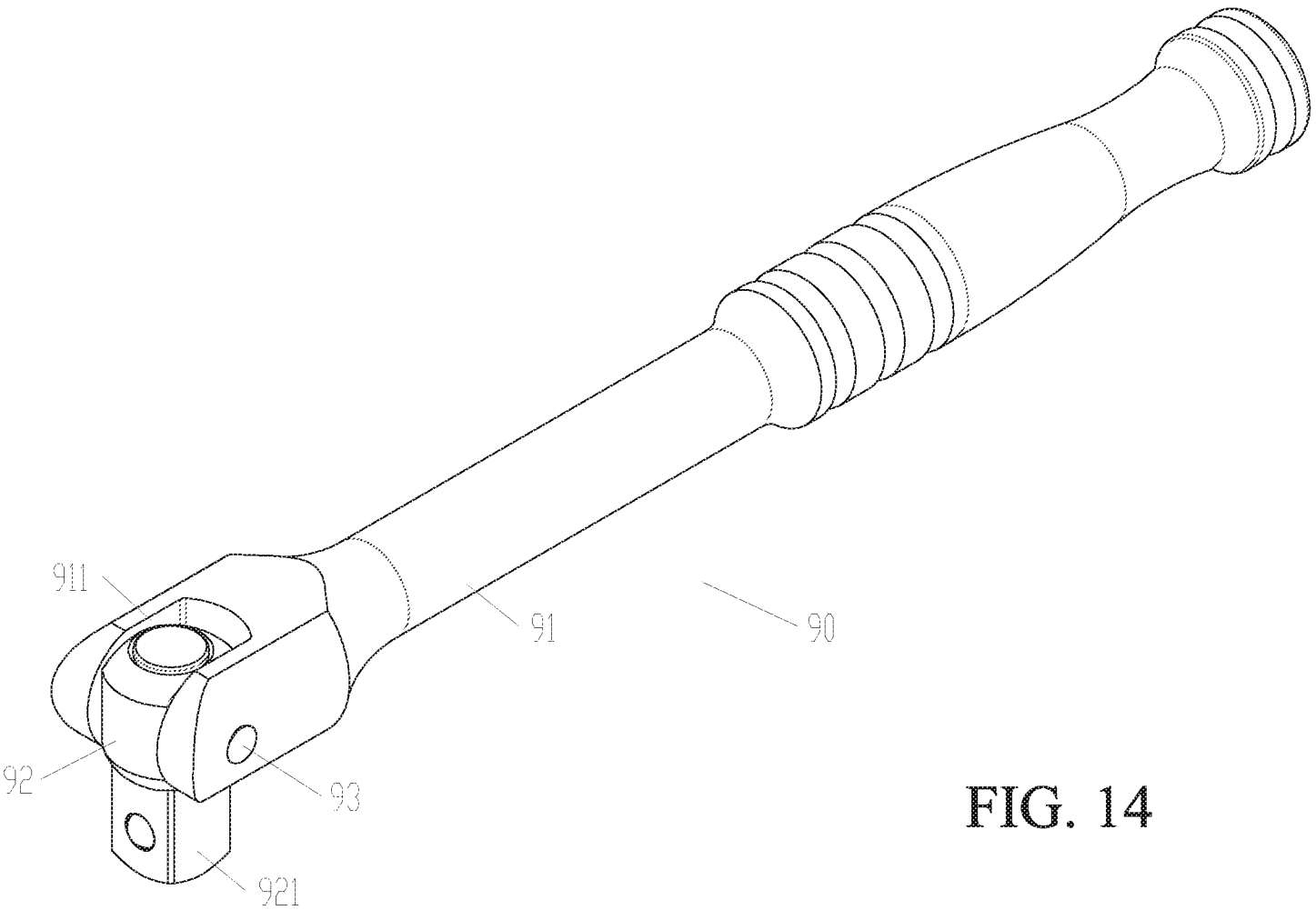
FIG. 14 is a perspective view of a conventional wrench structure in accordance with the prior art.

Referring to FIG. 13 with reference to FIGS. 1-4, the first mounting portion 11 of the first wrench body 10 is provided on the second mounting portion 13. The second mounting portion 13 is connected with the first pivot portion 12. The first receiving recess 14 has a reduced length. The first threaded section 141 is located at the opening of the first receiving recess 14. The first screw member 22 is screwed into the first threaded section 141, to close the first receiving recess 14. At this time, the second receiving recess 15, the second threaded section 16, the closure 23, the second ball 24, the second elastic member 25, and the second screw member 30 are undefined.

Accordingly, the wrench structure has the following advantages.

1. The first mounting portion 11 and the second mounting portion 13 are used to for mounting hand tools of two different specifications, thereby enhancing the versatility of the wrench structure.

2. The wrench structure is used to rotate different tools by different operation manners as shown in FIGS. 5, 7 and 8-10, to fit different working conditions.

3. The first wrench body 10 and the second wrench body 40 are pivoted relative to each other, and the third ball 51 is positioned in one of the positioning grooves 122, such that the angle between the first wrench body 10 and the second wrench body 40 is adjusted according to the user's requirement.

4. The first wrench body 10 and the second wrench body 40 are pivoted relative to each other to form an angle of ninety degrees between the first wrench body 10 and the second wrench body 40, such that the first wrench body 10 and the second wrench body 40 form an L-shaped arrangement.

5. The second screw member 30 is rotated and moved in the second threaded section 16 to press and lock the fifth mounting portion 63 of the first tool 60, such that the wrench structure is used to rotate the first tool 60 with different specifications by adjustment of the second screw member 30.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A wrench structure comprising:

a first wrench body, a first ball, a first elastic member, a first screw member, a second ball, a second elastic member, a second screw member, a second wrench body, a pivot member, a third ball, and a third elastic member;

wherein:

the first wrench body is provided with a first mounting portion which is a hexagonal through hole;

the first wrench body has a first end provided with a first pivot portion;

the first pivot portion is provided with a first pivot hole which has a circular shape;

the first pivot hole has an axis which is perpendicular to that of the first mounting portion;

the first pivot portion has an end portion provided with a plurality of positioning grooves;

the first wrench body has a second end provided with a second mounting portion which is a square head;

the first mounting portion is located between the first pivot portion and the second mounting portion;

the second mounting portion has an axis which is perpendicular to that of the first mounting portion;

the second mounting portion is provided with a first receiving recess which has a circular shape and is connected to the first mounting portion;

the first receiving recess has an axis which is perpendicular to that of the first mounting portion;

the first receiving recess is provided with a first threaded section which is an internal thread;

the first receiving recess is provided with a first abutting edge which is located between the first mounting portion and the first receiving recess;

the second mounting portion is provided with a second receiving recess which has a circular shape and is connected to the first receiving recess;

the second receiving recess has an axis which is perpendicular to that of the first receiving recess and is parallel with that of the first mounting portion;

the first threaded section is located between the first abutting edge and the second receiving recess;

the first wrench body has a side provided with a second threaded section which is an internal thread;

the second threaded section is connected to the first mounting portion and has an axis which is perpendicular to that of the first mounting portion;

the first ball is received in the first receiving recess and rests on the first abutting edge;

the first ball partially extends into the first mounting portion and is restricted by the first abutting edge;

the first elastic member is received in the first receiving recess and presses the first ball toward the first abutting edge;

the first screw member is screwed into the first threaded section, and rests on the first elastic member;

the first elastic member is biased between the first ball and the first screw member;

the second ball is received in and partially protrudes outward from the second receiving recess;

the second elastic member is received in the second receiving recess, and is biased between a wall of the second receiving recess and the second ball;

the second screw member has an external thread and is screwed into the second threaded section;

the second screw member is rotatable and movable in the second threaded section;

the second wrench body is provided with a second pivot portion which is pivotally connected with the first pivot portion of the first wrench body;

the second pivot portion has a U-shaped configuration and is provided with a second pivot hole which aligns with the first pivot hole;

the second pivot hole is connected to the second pivot portion;

the second pivot hole has a circular shape and has an end face provided with a third receiving recess which aligns with one of the positioning grooves;

the third receiving recess is connected to the second pivot portion;

the pivot member is a circular shaft which extends through the second pivot hole and the first pivot hole, such that the second wrench body is pivotally connected with the first wrench body;

the third ball is received in the third receiving recess and is positioned in one of the positioning grooves; and the third elastic member is received in the third receiving recess and is biased between a wall of the third receiving recess and the third ball, to push the third ball toward the first pivot portion.

2. The wrench structure of claim 1, further comprising:

a closure received in the first receiving recess and located at an opening of the first receiving recess, to close the first receiving recess.

3. The wrench structure of claim 1, wherein:

the second elastic member is arranged between the first screw member and the closure; and the second receiving recess has a reduced diameter, to limit the second ball.

4. The wrench structure of claim 1, wherein:

a first tool is connected with the wrench structure;

the first tool includes a third mounting portion, a fourth mounting portion, and a fifth mounting portion;

the fourth mounting portion is a square recess which is formed in the third mounting portion;

the fifth mounting portion is connected with the third mounting portion;

the fifth mounting portion is a hexagonal pole which extends through the first mounting portion; and the fifth mounting portion is movable in the first mounting portion, to adjust a position of the fifth mounting portion relative to the first wrench body.

5. The wrench structure of claim 4, wherein:

the fifth mounting portion is provided with a plurality of annular grooves;

one of the annular grooves aligns with the first receiving recess; and the first ball is pushed by the first elastic member, and is received in one of the annular grooves.

6. The wrench structure of claim 1, wherein:

the first mounting portion of the first wrench body is provided on the second mounting portion;

the second mounting portion is connected with the first pivot portion;

the first threaded section is located at an opening of the first receiving recess; and the first screw member is screwed into the first threaded section, to close the first receiving recess.

* * * * *